US005336050A

United States Patent [19]

Guida et al.

[11] Patent Number: 5,336,050

[45] Date of Patent: Aug. 9, 1994

[54] VENTILATOR FAN DEVICE

[75] Inventors: Joseph Guida, Turnersville; Hani M. Odeh, Sicklerville, both of N.J.

[73] Assignee: Penn Ventilator Co. Inc., Philadelphia, Pa.

[21] Appl. No.: 58,976

[22] Filed: May 6, 1993

[51] Int. Cl.[5] ..... F01D 5/22

[52] U.S. Cl. ..... 416/186 R; 416/213 R; 29/889.21; 29/889.22

[58] Field of Search ..... 416/204 R, 204 A, 213 R, 416/213 A, 214 R, 186 R, 188; 29/889.21, 889.22

[56] References Cited

U.S. PATENT DOCUMENTS

| | | | |
|---|---|---|---|
| 3,224,078 | 12/1965 | Mayne | 416/186 |
| 3,224,079 | 12/1965 | Dybvig | 416/186 |
| 3,225,422 | 12/1965 | Sebok | 416/186 |
| 3,260,443 | 7/1966 | Garnett et al. | 416/213 A |
| 3,298,444 | 1/1967 | Haas | 416/186 |
| 3,668,887 | 6/1972 | Riello | 416/186 |
| 3,952,712 | 4/1976 | Hermanson | 416/244 |
| 4,322,200 | 3/1982 | Stiegelmeier | 416/186 |
| 5,082,425 | 1/1992 | Reil et al. | 416/213 R |

FOREIGN PATENT DOCUMENTS

| | | | |
|---|---|---|---|
| 33102 | 3/1977 | Japan | 416/186 R |
| 190499 | 10/1984 | Japan | 416/186 R |
| 18349 | of 1911 | United Kingdom | 416/213 A |

*Primary Examiner*—John T. Kwon
*Attorney, Agent, or Firm*—Eugene E. Renz, Jr.

[57] ABSTRACT

A ventilator fan device including a male wheel, a female wheel and arcuate blades. The male wheel forms an end plate having an axis of rotation. The end plate includes a hub for mounting the wheel to a shaft. The female wheel forms a ring inlet for axial inlet of air. A plurality of longitudinal arcuate blades extend between and conform to the plate annular portion and the ring inlet. The blades are positioned for radial discharge of air upon rotation of about the axis. Substantially uniform robotic welds permanently affixing the blades to the end plate and the ring inlet.

23 Claims, 7 Drawing Sheets

VENTILATOR FAN DEVICE

FIELD OF THE INVENTION

The present invention relates to tangential blade fan devices and more particularly to low pressure ratio exhaust fans which transfer air without substantially compressing the air being moved.

BACKGROUND OF THE INVENTION

Ventilator tangential blade fans have been in use since at least the 1920's and are designed to move large quantities of air efficiently. Most fan blades are shrouded in a housing and are designed to operate at a fixed speed. Typically, these fans operate with a low static pressure. Air enters axially through an inlet and is turned approximately 90° to enter the minimum flow area between the blades. The air is then turned again by contact with the blades, which are also at an angle with respect to the path of air flow. Finally, air is turned as it is exhausted from the fan in a generally radial direction.

While fans of this type are classified by some as centrifugal compressors, there is a marked difference between ventilating fan pressure ratios, which do not generally exceed 1.015, and centrifugal compressors which operate at pressure ratios as high as 3.0. Conventional designs of prior art ventilator fans have, for the most part, been made with a flat plate to which is added a riveted hub. An inlet face is also provided, with blades extending between the flat plate and hub and the inlet face. Because of the large variety of bore sizes in the industry, it may be necessary to stock over 1,000 wheels.

With conventional ventilator fan designs, efficiency has not been uniformly achieved. Oftentimes large energy losses are experienced simply because the fan is not properly balanced on the motor. When conventional designs are assembled, with large riveted hubs and individually welded blades, a great deal of time is expended by skilled workers in balancing the fan by a trial and error method. More importantly, at the present time there is no really effective way to evaluate the many variables of design once the air flow, power and inlet pressure requirements are set for new or existing designs.

In designing a new fan system or fitting a fan device into an existing ventilation system, the first step is to identify the parameters of the system. It has been found that the criteria which determine the system are the flow rate, horsepower, speed and pressure drop. From this set of criteria certain variables exist which must be selected or determined to create a fan useful with those criteria. For example, the given criteria for a particular system may be met by a fan with nine blades or ten, or twelve blades. Similarly, a fan that is of an axial length of six inches and a different fan with an axial length of ten inches may both accomplish the goals of the system. However, the actual space available for replacement of the fan device and other factors may cause the designer to eliminate designs which are too tall or where the diameter is too large or too small. As a result, only a few selected designs will be available for practical consideration.

The prior art does not provide any method for selecting the optimum fan design for ventilation exhaust systems. Ness U.S. Pat. No. 1,637,652 discloses a fan or blower having a plurality of blades between a plate having a hub and an inlet. The blades are arcuate in cross section. This generally represents the fan design that has existed since at least the mid 1920's. Curved blades or blades with a variable pitch are shown in Valentine, U.S. Pat. No. 2,201,947. Two other turbine type blower wheels are shown in Dybvig, U.S. Pat. No. 3,179,329 and Jenson, U.S. Pat. No. 3,507,581.

The foregoing prior art patents all describe conventional fan devices which have certain limitations and draw backs such as those discussed above. Dybvig, for example, spot welds blower blades to mount them, thus making it difficult to balance the blades if long term operation and efficiency is desired. Dybvig, of course, is directing air in a conical direction and is not a true exhaust or ventilating systems. None of the known prior art actually addresses the design factors which contribute to optimization of exhaust or ventilation systems. There is no criteria set forth which allows one direct comparison of fan devices, except perhaps by trial and error. Two fan devices might both be tried in a system and energy cost, maintenance, noise, or other measurable factors may or may not show which system is more effective, depending in part on the weight given each factor. There is no way to determine in advance whether either design will be effective, nor can the two designs be compared without experimentation.

Accordingly, it is an object of this invention to provide an optimized manufacturing process for producing useful and reliable fans devices.

Another object of the present invention is to provide a fan device which is balanced both radially and axially, and which has increased concentricity and reproducability.

Yet another object of the present invention is to provide a fan device which is most efficient for a given flow rate, power requirement, air speed and air pressure drop.

Other objects will appear hereinafter.

SUMMARY OF THE INVENTION

It has now been discovered that the above and other objects of the present invention may be accomplished in the following manner. Specifically, a new ventilator fan device has been discovered which contains certain features which provide an optimum efficiency and effectiveness.

The device includes a male wheel forming an end plate having an axis of rotation. Also provided is a female wheel forming a ring inlet for axial inlet of air. A plurality of longitudinally straight arcuate blades extend between and attach to the end plate and the ring inlet to form the completed device.

The male wheel which forms an end plate has an annular portion terminating in an annular rim. A plurality of slots are made on the surface of the annular portion for alignment of the blades. The end plate further has an axially inwardly directed conical portion having an axially centered hole for mounting a hub. The hub is mounted in the axially centered hole and is used to attach the ventilator fan to a shaft on a motor.

The female wheel includes an inner annular lip defining the inlet and an annular inwardly curved face extending from the inlet to an outer annular lip substantially the same diameter as the annular portion of the end plate. The annular inwardly curved face includes a plurality of holes on the surface thereof in a pattern for aligning and mounting the blades to the female wheel.

The blades are generally longitudinally straight and have a slight arc or curve. The curvature of the blade is a true radius which is defined by a relationship with the chord of the arc. Specifically, the rise of the arc at its center point is 1/32 of length for every unit of length of the chord. Thus, if the chord length is 8 inches, the rise in the arc will be $8\times1/32$ or $\frac{1}{4}$ inch. Variations of 0.005 units of length are acceptable.

Each blade extends between the annular plate portion of the male wheel and the inwardly curved face of the ring inlet. The blade has a first end conforming to the annular plate portion and has tabs for engagement with the slots. The blades also have a second end conforming to the inlet face, including the curved surface, and have tabs for engagement with the holes. The slots and holes position the blades for optimum operation, as will be described below.

In a preferred embodiment, the number of blades range from about nine to about twelve blades per fan device and preferably from ten to about twelve blades. Since the blades are equally spaced, when twelve blades are employed, they will be spaced radially by 30° from each other. The trailing edge of the blade is positioned at or near the outer periphery of the end plate annular portion and the outer annular lip of the inlet curved surface. The leading edge of each blade extends inward to a point radially inward from the inner annular lip of the ring inlet. The arcuate width R is selected so that the desired number of blades are positioned as described and to produce an overlap of the leading edge of each blade in front of the trailing edge of the blade adjacent thereto. Blade overlap is defined by the distance between the leading edge of a blade and a line extending normal or perpendicular to the chord of that blade and intersecting the trailing edge of an adjacent blade. Blade overlap should range from less than $\frac{1}{4}$ inch to two inches or more for most fan devices.

In addition, it has been found that concentricity and reproducability is markedly improved and increased when the male wheel and female wheel blades are stamped from aluminum stock, rather than the previous or prior art method of using spun aluminum. The stamped parts also facilitate final assembly since they are less out of round and are more interchangeable. The tab and slot arrangement as previously described places the parts in the specific desired positions for the purpose of being welded. Robotic or automatic welding is a preferred method for joining the parts together to improve weight distribution and remove undesired vibration caused by an assembly which is out of balance.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
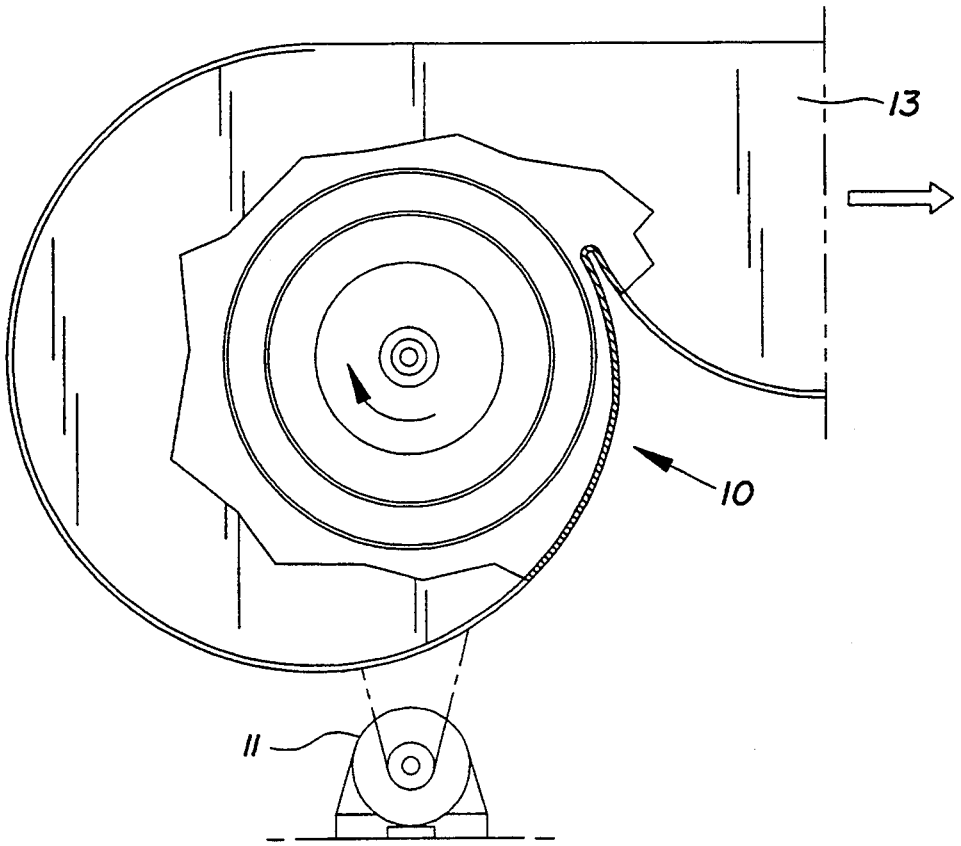
FIG. 1 is schematic front elevational view of a typical centrifugal fan driven by an electric motor, as viewed from the inlet side with a portion of the casing broken away.

As shown in FIG. 1 by the reference numeral 10 generally, there is a typical centrifugal fan arrangement driven by a motor 11 to produce an air flow in duct work 13. A portion of the duct work 13 has been broken away to show the position of the fan device of this invention which is being driven by motor 11 to produce a flow of air in the direction shown by the arrow emanating from duct 13.

Figure 2:
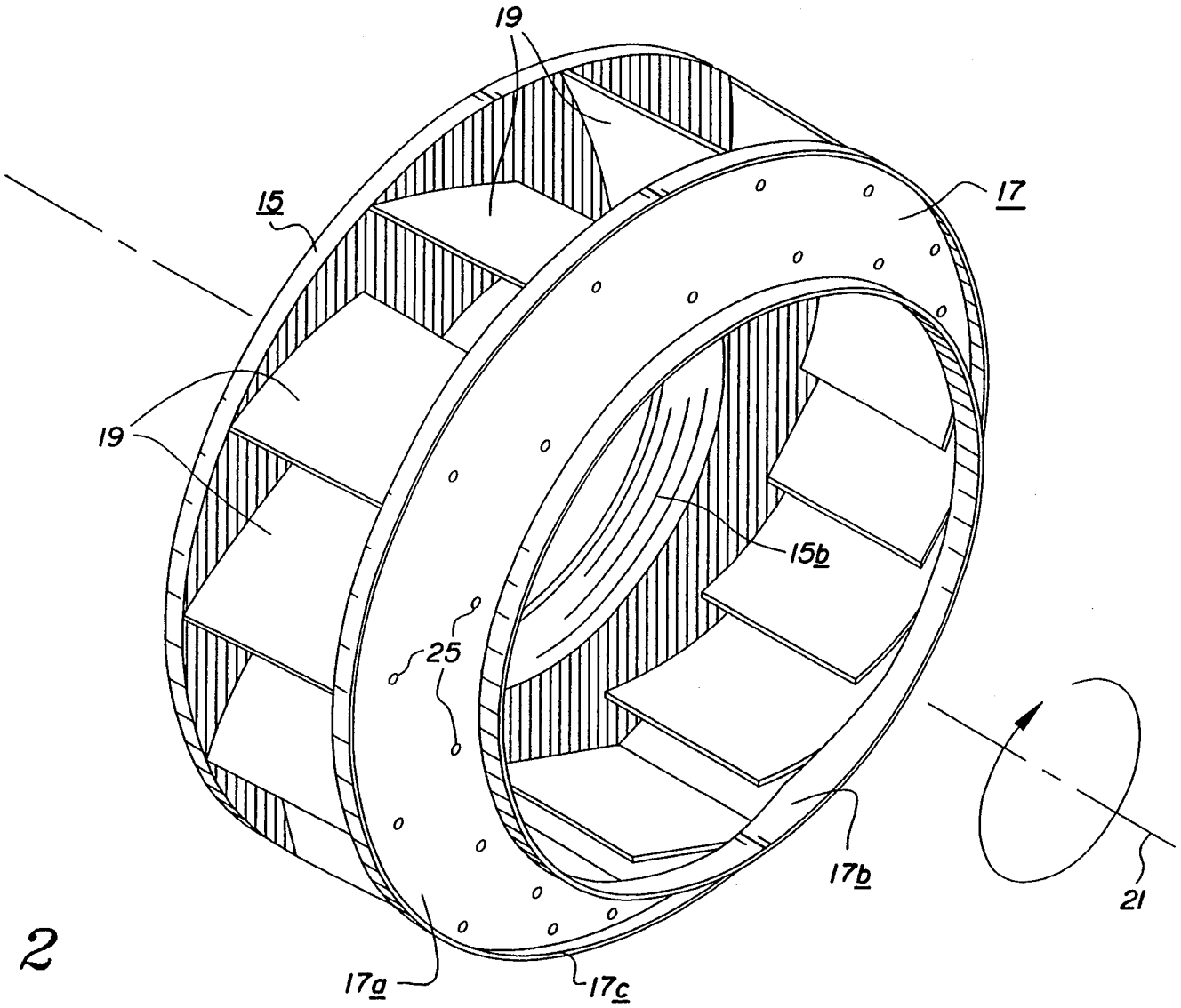
FIG. 2 is an isometric view of a centrifugal fan rotor showing details of assembly, all in accordance with the invention.

In its simplest form, the fan device of the present invention is shown in an isometric view in FIG. 2. The device includes a male wheel forming an end plate 15, a female wheel forming a ring inlet 17 and a plurality of longitudinal straight arcuate blades 19, with each blade 19 extending between the plate annular portion 15 and the inlet face 17. The fan device rotates about axis 21 in the direction shown by the arrow.

Figure 5:
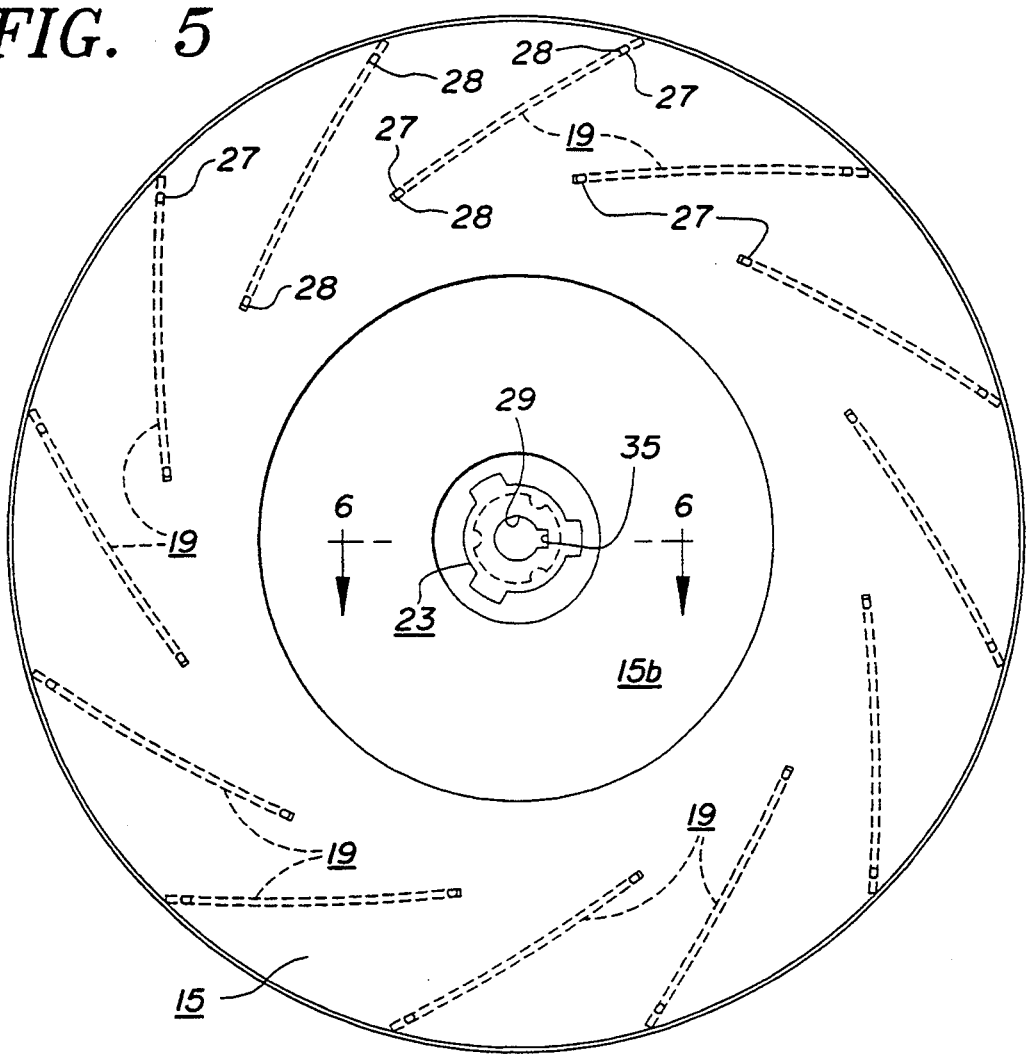
FIG. 5 is an enlarged rear elevational view of the rotor assembly shown in FIGS. 2–4.

As shown in FIG. 2 and elsewhere, the ring inlet 17 includes an annular inwardly curved face $\mathbf{17}^a$ extending from an inner annular lip $\mathbf{17}^b$ which annular lip $\mathbf{17}^b$ defines the inlet of the ventilator fan. Face $\mathbf{17}^a$ extends outward from the inlet $\mathbf{17}^b$ to a rim $\mathbf{17}^c$ which has substantially the same diameter as annular plate 15. Curved face $\mathbf{17}^a$ includes a plurality of holes 25 which have been punched or cut into the face of the metal in order to locate and position that portion of blades 19 which is attached to face $\mathbf{17}^a$. It should be noted that holes 25 are in fact round holes, as distinguished from slots 27 in plate 15, as shown, for example, in FIG. 5. It has been found that slots are precise for locating blades when slots are cut in flat surfaces. However, curved face $\mathbf{17}^a$ does not present a flat surface for a slot to be cut or punched therein. Accordingly, a circular punch is used to create round holes in the curved face. This results in substantially extended tool life and a high degree of accuracy in precisely locating the holes on the curved face.

Figure 6:
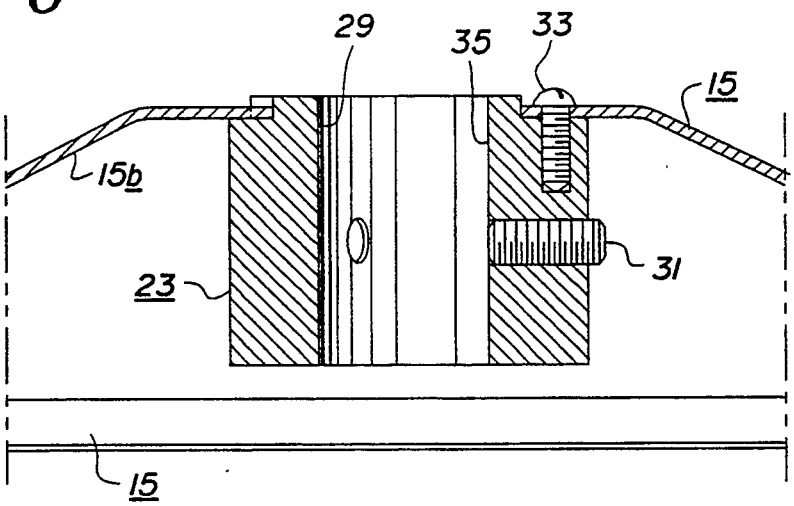
FIG. 6 is an enlarged fragmentary sectional view taken along the lines 6,6 of FIG. 5 showing details of the hub design and attachment.

As is noted in FIG. 6 and elsewhere, a hub 23 is attached to the end plate 15 for mounting the hub bore 29 on a shaft (not shown) to rotate the fan device. Hub 23 is fastened to the shaft by set screw 31 and the end plate 15, by threaded screws 33. Key slot 35 engages a key (not shown) on the shaft to prevent slippage. Compared to the standard prior art hub (with a 6 inch diameter or greater) riveted to the wheel, it can be seen that the present hub is substantially more compact and has a more uniformed center of gravity due to its smaller size.

Figure 4:
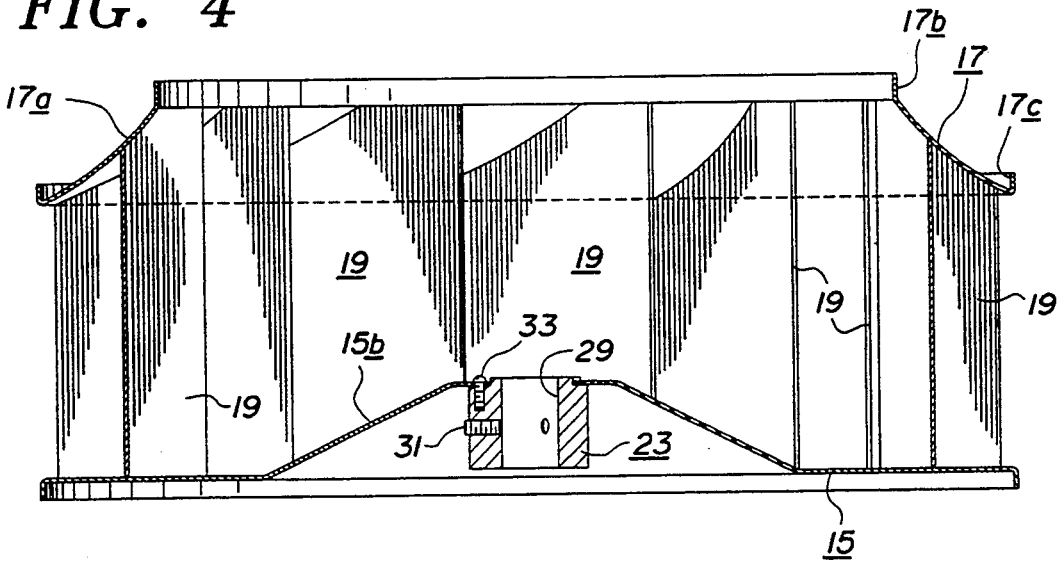
FIG. 4 is a sectional view taken along the lines 4,4 of FIG. 3.

Hub 23 is preferably attached to a portion 15$^b$ of end plate 15, shown in FIG. 4, which is an inwardly directed conical portion. Conical portion 15$^b$ serves to recess hub 23 and to present an angular surface to assist in changing the direction of air flow into the fan in cooperation with curved face 17$^a$ as previously described.

Figure 3:
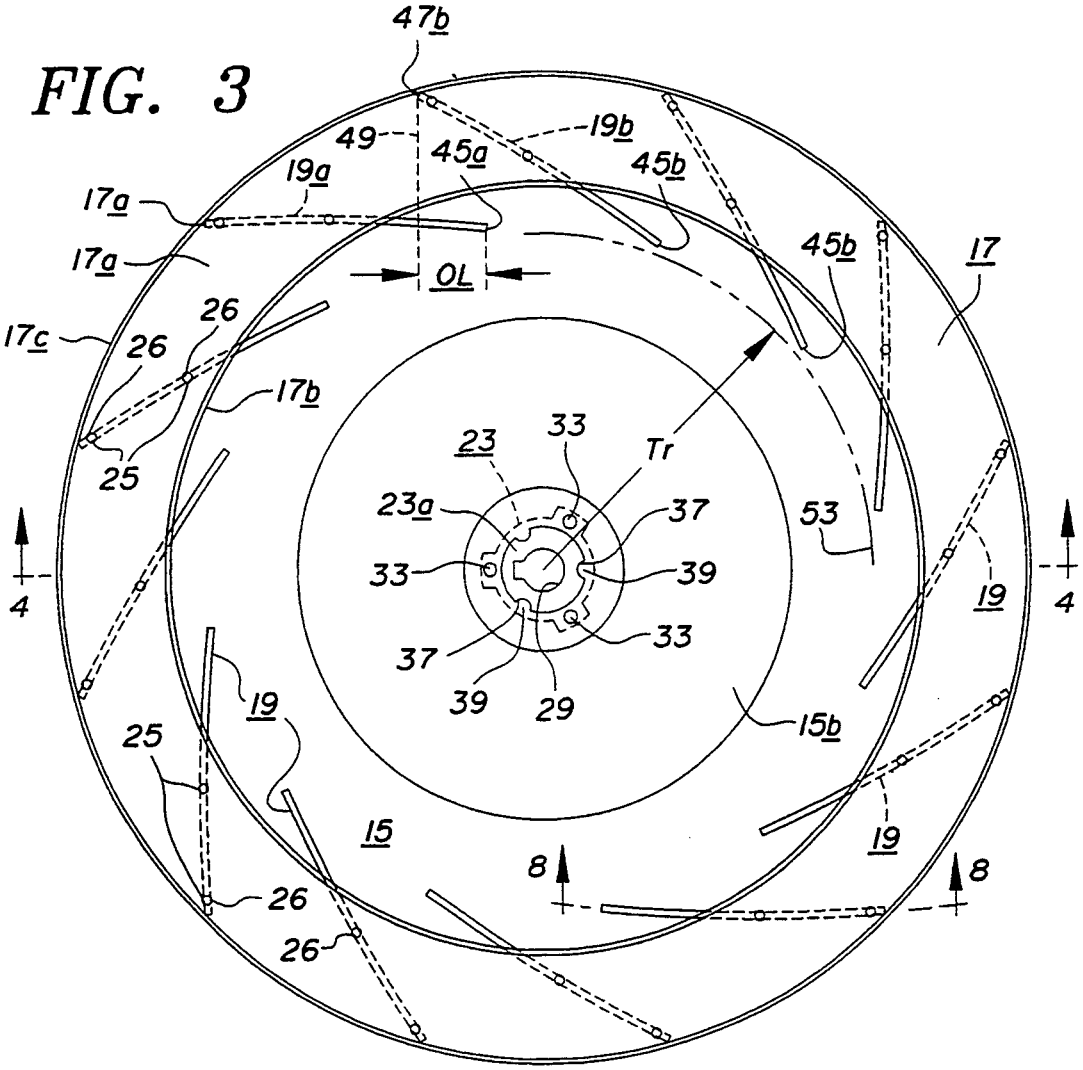
FIG. 3 is an enlarged front elevational view of the rotor assembly shown in FIG. 2.
Figure 7:
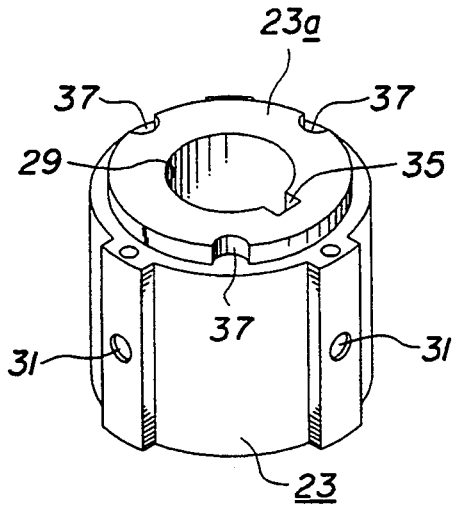
FIG. 7 is an isometric view of the hub member shown in FIG. 6.
Figure 11:
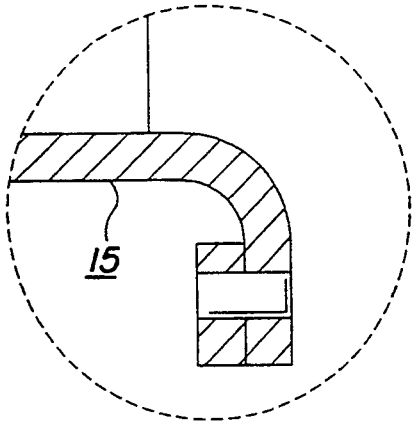
FIG. 11 is a greatly enlarged fragmentary view of the rim detail contained within the dot and dash circle of FIG. 8.

Because hub 23 is easily detached from end plate 15, one wheel can be fitted to a variety of shafts having different bore sizes, so that substantially fewer wheels are necessary to be kept in stock. It is preferred that the hub 23 be extruded from aluminum or other compatible materials. Also included in hub 23 is an end portion 23$^a$which has a plurality of slots 37, as shown in FIG. 7. As can be seen in FIG. 3 hub 15 includes a similar plurality of tabs 39 which mate with slots 37 to secure the end portion 23$^a$ of hub 23 and prevent rotation of hub 23 with respect to end plate 15. The combination of threaded screws 33 and the mating slots 37 and tabs 39 provide substantially improved dimensional stability during long periods of rotation of the fan unit, thereby prolonging the life of the fan device and the drive motor.

Figure 9:
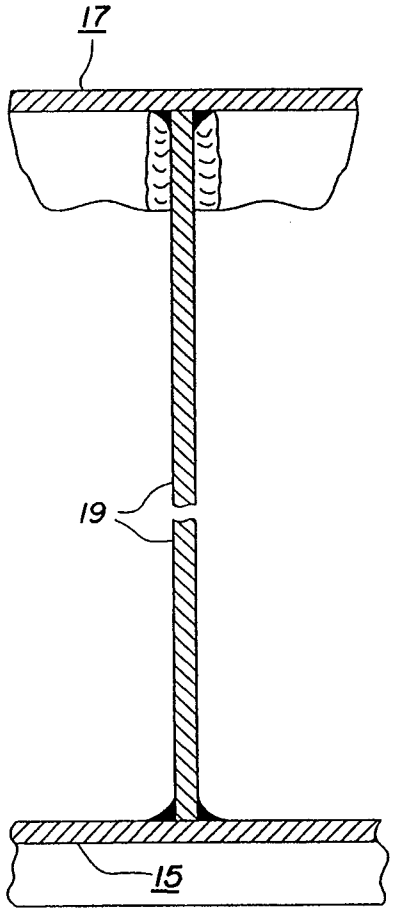
FIG. 9 is an enlarged fragmentary sectional view taken along the line 9,9 of FIG. 8.
Figure 8:
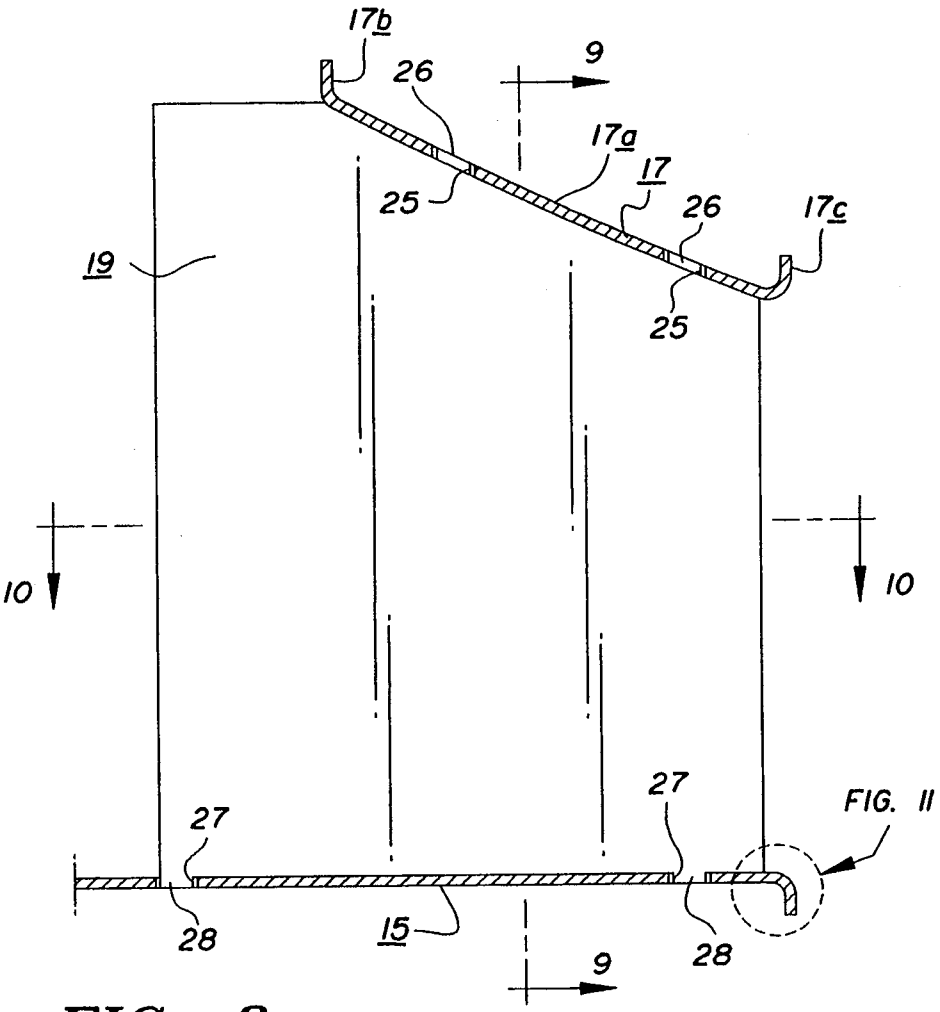
FIG. 8 is an enlarged fragmentary sectional view taken along the line 8,8 of FIG. 3, showing details of the blade and the positioning and mounting means of the blade with respect to the female inlet plate and the male back plate.
Figure 10:
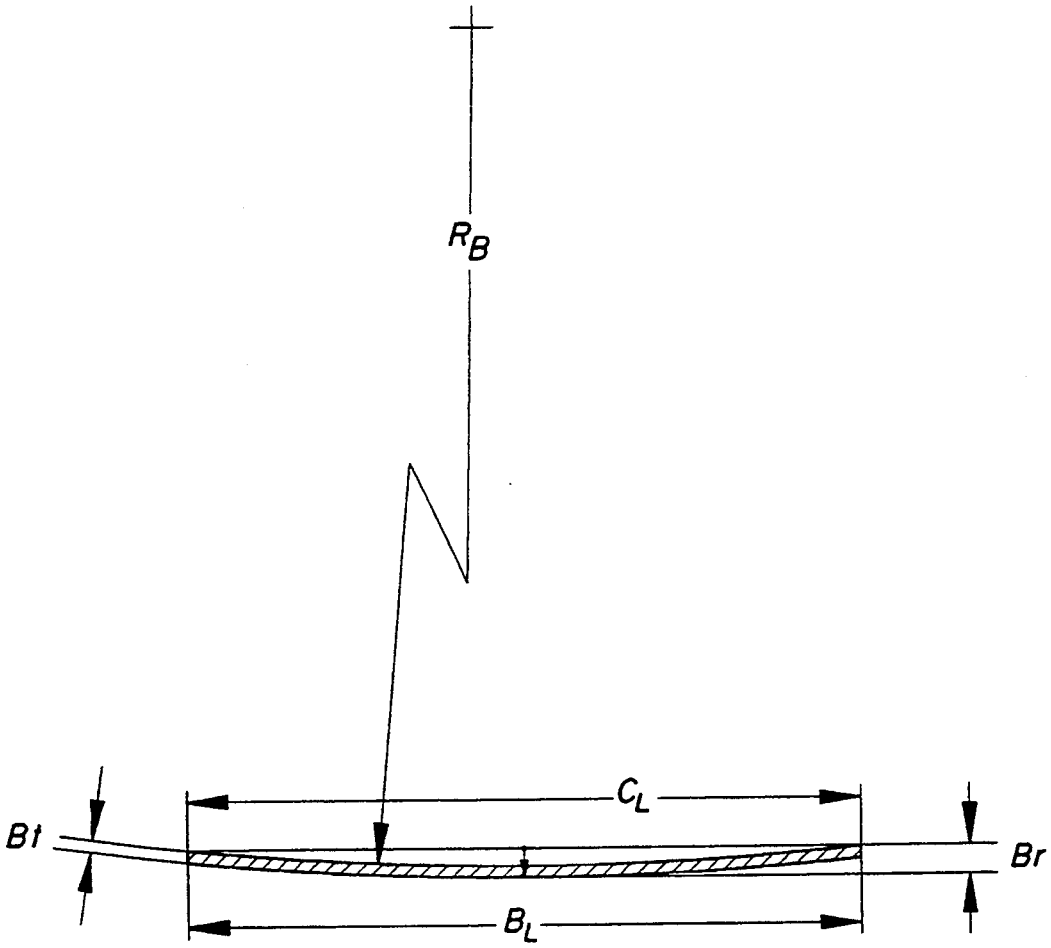
FIG. 10 is an sectional plan view taken along the line 10,10 of FIG. 8.

Turning now to FIGS. 8 through 10, the specific construction of the blade can be seen. Blade 19 includes a plurality of tabs 28 which extend into slots 27 on end plate 15 as the bottom terminal end of plate 19 conforms to the flat surface of end plate 15. Similarly, the top end of blade 19 includes tabs 26 which engage with holes 25 in curved faced 17$^a$ of front ring 17. As seen in FIG. 9, blade 19 is substantially straight from end plate 15 to front ring 17 and has been firmly attached to those surfaces by uniform robotic or automatic welding. Preferably robotic or automatic welding is used to provide better balance and more uniform weight distribution. The thickness of the wire can be up to 50% less than welds made in conventional or hand welding methods. Typically 0.035 welding wire is used. In order to set repeatability from weld to weld, so that all of the blades are uniform in size and shape, the length and location of welding wire should be within 1/64 of an inch for each weld.

Blade 19 is also arcuate about a radius $R_b$, as shown in FIG. 10. Blade 19 functions as an air foil and has a true radius $R_p$. Blades have a nominal thickness $B_t$ which is as thin as possible while being able to withstand forces to which it is subjected. As is clearly shown, the blade 19 has a rise $B_r$ which represents the amount of curvature of the blade. It has been discovered that this length $B_r$ should be about 1/32 units of length, such as inches typically, for every one unit of length of chord $C_e$. Thus, for a chord $C_l$ length of 8 inches, the rise $B_r$ will be $8 \times 1/32$ or $\frac{1}{4}$ inch. It has been found that these precise relationship plus or minus 0.010 units of length produces the maximum flow of air for any given rate of rotation and power consumption, at least under circumstances of low pressure air flow as previously described.

In addition to the curve of the blades 19, certain other relationships between the blades, the end plate and front ring are necessary for optimization of the ventilation fan device of the this invention. Specifically, as can be seen in FIG. 3 the relationship between blades 19$^a$ and 19$^b$ is typical of the relationship of all of the blades 19. The leading edges 45$^a$ and 45$^b$ extend radially inside inlet 17$^b$. Trailing edges 47$^a$ and 47$^b$, for example, are at approximately the outer edge of the annular rim 17$^c$ of front ring 17. FIG. 3 also shows a third relationship between blades 19. As can be seen, the leading edge 45$^a$ of blade 19$^a$ "overlaps" or extends in front of the trailing edge 47$^b$ of blade 19$^b$ by a linear distance OL. Overlap distance OL is defined by the distance between the leading edge 45$^a$ and line 49, which is a line extending normal to its chord (shown by the straight line between ends 45$^a$ and 47$^a$ in FIG. 3) and intersecting the trailing edge 47$^b$ of blade 19$^b$. The chords 51 of all the blades 19 define a tangent circle 53 having a radius $T_r$. While particular embodiments of the present invention have been shown herein, other modifications and changes will be apparent from the foregoing description. Such changes and modifications may be made within the scope of the following claims.

What is claimed is:

1. A ventilator fan device comprising:

a male wheel forming an end plate and having an axis of rotation, said end plate having an annular portion including a plurality of slots on the surface thereof and terminating in an annular rim, said end plate having hub means for mounting said wheel to a shaft;

a female wheel forming a ring inlet for axial inlet of air, said ring inlet having an inner annular lip defining said inlet, and annular inwardly curved face extending from said inlet to an outer terminal lip having substantially the same diameter as said end plate annular rim, said curved face having a plurality of holes on the surface thereof;

a plurality of longitudinally straight arcuate blades, each blade extending between said plate annular portion and said curved face, said blades having a first end conforming to said plate annular portion and having tabs for engagement with said slots, said blades also having a second end conforming to said curved inlet face and having tabs for engagement with said holes, said slot and holes positioning said blades for radial discharge of air upon rotation about said axis, said curved face having a rise of curvature equal to about 1/32 of the length of the chord of said blade; and substantially uniform robotic welds permanently affixing said blades to said plate annular portion and said ring inlet curved faced.

2. The device of claim 1, wherein the blade width and the number of blades in said plurality are sufficient to align each blade such that the leading edge of each blade overlaps the trailing edge of the blade adjacent said each blade.

3. The device of claim 2, wherein said trailing edge of each blade is positioned proximate the outside diameter of said end plate and said outer terminal lip of said ring inlet to define an outer circle of rotation.

4. The device of claim 2, wherein said blades are aligned with respect to each other to produce an overlap between adjacent blades, said overlap being defined by the distance between the leading edge of a blade and a line extending normal to the chord of said blade and intersecting the trailing edge of an adjacent blade.

5. The device of claim 3, wherein said leading edge of each of said blades extends radially inward of the inner annular lip of said ring inlet.

6. The device of claim 1, wherein the number of blades is from nine to twelve.

7. The device of claim 6, wherein the number of blades is from ten to twelve.

8. The device of claim 1, wherein said hub means is mounted on said end plate with slot and tab means to prevent rotational movement therebetween.

9. The device of claim 8, wherein said end plate includes an inwardly directed conical portion for mounting said hub, said conical portion being positioned to deflect air entering said device through said ring inlet.

10. A ventilator fan device comprising:

a male wheel forming an end plate and having a axis of rotation, said end plate having an annular portion including a plurality of slots on the surface thereof and terminating in an annular rim, said end plate having hub means for mounting said wheel to a shaft;

a female wheel forming a ring inlet for axial inlet of air, said ring inlet having an inner annular lip defining said inlet, and annular inwardly curved face extending from said inlet to an outer terminal lip having substantially same diameter as said end plate annular rim, said curved face having a plurality of holes on the surface thereof;

a plurality of longitudinally straight arcuate blades, each having a rise of curvature equal to about 1/32 of the length of the chord of said blade, each blade extending between said plate annular portion and said curved face, said blades having a first end conforming to said plate annular portion and having tabs for engagement with said slots, said blades also having a second end conforming to said curved inlet face and having tabs for engagement with said holes, said slot and holes positioning said blades for radial discharge of air upon rotation about said axis; and substantially uniform robotic welds permanently affixing said blades to said plate annular portion and said ring inlet curved face, said blades being configured such that the trailing edge of each blade is positioned proximate the outside diameter of said end plate and said outer terminal lip of said ring inlet to define an outer circle of rotation and the leading edge of each of said blades extends radially inward of the inner annular lip of said ring inlet.

11. The device of claim 10, wherein the blade width and the number of blades in said plurality are sufficient to align each blade such that the leading edge of each blade overlaps the trailing edge of the blade adjacent said each blade.

12. The device of claim 10, wherein the number of blades is from nine to twelve.

13. The device of claim 12, wherein the number of blades is from ten to twelve.

14. The device of claim 10, wherein said blades are aligned with respect to each other to produce an overlap between adjacent blades, said overlap being defined by the distance between the leading edge of a blade and a line extending normal to the chord of said blade and intersecting the trailing edge of an adjacent blade.

15. The device of claim 10, wherein said hub means is mounted on said end plate with slot and tab means to prevent rotational movement therebetween.

16. The device of claim 15, wherein said end plate includes an inwardly directed conical portion for mounting said hub, said conical portion being positioned to deflect air entering said device through said ring inlet.

17. A method of assembling a ventilator fan device comprising the steps of:

forming a male wheel into an end plate having an axis of rotation, said end plate having an annular portion including a plurality of slots on the surface thereof and terminating in an annular rim, said end plate having hub means for mounting said wheel to a shaft;

forming a female wheel into a ring inlet for axial inlet of air, said ring inlet having an inner annular lip defining said inlet, and an annular inwardly curved face extending from said inlet to an outer terminal lip having substantially the same diameter as said end plate annular rim, said curved face having a plurality of holes in the surface thereof;

forming a plurality of longitudinally straight arcuate blades, each having a rise of curvature equal to about 1/32 of the length of the chord of said blade, aligning each blade between said plate annular portion and said curved face, said blades having a first end conforming to said plate annular portion and engaging said slots with tabs on said blade first end, said blades also having a second end conforming to said curved inlet face and engaging said holes with tabs on said second end, said slot and holes positioning said blades for radial discharge of air upon rotation about said axis; and welding said blades with substantially uniform robotic welds to permanently affix said blades to said plate annular portion and said ring inlet curved face, said blades being configured such that the trailing edge of each blade is positioned proximate the outside diameter of said end plate and said outer terminal lip of said ring inlet to define an outer circle of rotation and the leading edge of each of said blades extends radially inward of the inner annular lip of said ring inlet.

18. The method of claim 17, wherein the blade width and the number of blades in said plurality are sufficient to align each blade such that the leading edge of each blade overlaps the trailing edge of the blade adjacent said each blade.

19. The method of claim 17, wherein the number of blades is from nine to twelve.

20. The method of claim 19, wherein the number of blades is from ten to twelve.

21. The method of claim 17, wherein said blades are aligned with respect to each other to produce an overlap between adjacent blades, said overlap being defined by the distance between the leading edge of a blade and a line extending normal to the chord of said blade and intersecting the trailing edge of an adjacent blade.

22. The method of claim 17, wherein said hub means is mounted on said end plate with slot and tab means to prevent rotational movement therebetween.

23. The method of claim 22, wherein said end plate is formed with an inwardly directed conical portion for mounting said hub, said conical portion being positioned to deflect air entering through said ring inlet.

* * * * *